US005804910A

United States Patent [19]

Tjaden et al.

[11] Patent Number: 5,804,910

[45] Date of Patent: Sep. 8, 1998

[54] FIELD EMISSION DISPLAYS WITH LOW FUNCTION EMITTERS AND METHOD OF MAKING LOW WORK FUNCTION EMITTERS

[75] Inventors: Kevin Tjaden; James J. Alwan, both of Boise, Id.

[73] Assignee: Micron Display Technology, Inc., Boise, Id.

[21] Appl. No.: 599,443

[22] Filed: Jan. 18, 1996

[51] Int. Cl.[6] ..... H01J 1/30

[52] U.S. Cl. ..... 313/310; 333/336

[58] Field of Search ..... 445/24; 313/308, 313/309, 310, 336

[56] References Cited

U.S. PATENT DOCUMENTS

| | | | |
|---|---|---|---|
| 5,089,292 | 2/1992 | MaCauley et al. | 427/78 |
| 5,358,908 | 10/1994 | Reinberg et al. | 437/228 |
| 5,372,901 | 12/1994 | Rolfson et al. | 430/5 |
| 5,372,973 | 12/1994 | Doan et al. | 437/228 |
| 5,391,259 | 2/1995 | Cathey et al. | 156/643 |
| 5,647,998 | 7/1997 | Potter | 216/24 |

*Primary Examiner*—John Goodrow
*Attorney, Agent, or Firm*—Hale and Dorr LLP

[57] ABSTRACT

A cold cathode structure, useful for field emission displays, is disclosed. A thin resistive silicon film is disposed on a glass substrate; conductive emitter tips are disposed on top thereof. An alloy of amorphous silicon and amorphous carbon is used for the emitter tips. The proportion of the carbon in the alloy increases, gradually or abruptly, from the base to the top of the emitter tips.

The carbon gradient is implemented during the process step, in which an n-type silicon layer is formed from which the emitter tips are made in subsequent masking and etching steps. The amount of carbon makes the emitter tips harder and gives lower work function at greater stability. Moreover, the carbon gradient allows for additional sharpening of the emitter tips.

36 Claims, 3 Drawing Sheets

FIELD EMISSION DISPLAYS WITH LOW FUNCTION EMITTERS AND METHOD OF MAKING LOW WORK FUNCTION EMITTERS

This invention was made with Government support under Contract No. DABT63-93-C-0025 awarded by Advanced Research Projects Agency (ARPA). The Government has certain rights in this invention.

BACKGROUND OF THE INVENTION

The present invention relates to the production of cold cathode emission sites having emitter tips for releasing electron beams. More particularly, the present invention relates to the manufacturing of hard, stable and sharp emitter tips having a low work function for emitting the electron beams. Such cathode structures are particularly useful in field emission display devices.

There are numerous designs for manufacturing cathode structures for field emission displays. For example, see the following U.S. Patents, all of which are incorporated herein by reference: U.S. Pat. No. 5,358,908; U.S. Pat. No. 5,372,901; U.S. Pat. 5,372,973; and U.S. Pat. No. 5,391,259.

While the use of emitter tips for field emission displays is known, low work function tips have proved difficult to achieve. For example, see U.S. Pat. No. 5,089,292, issued in 1992 to MaCaulay, et al., and incorporated herein by reference. MaCaulay discloses an elaborate method for applying a low work function material as a coating. However, once the low work function material is applied, there is no method disclosed by which the cathodes, which are coated with a highly-reactive, low work function material can be moved to an assembly point with an anode. Moving such a device within a vacuum for all of the processing steps is not commercially feasible.

Accordingly, there is a need for a method of manufacturing a field emission device with a low work function emitter tip. Also, there is a need for a method of manufacture of such a device that does not require complex and expensive handling steps before assembly.

It is an object of the present invention to address the above-mentioned needs.

SUMMARY OF THE INVENTION

According to the present invention, there is provided a field emission device comprising: an anode having phosphor deposited thereon; a cathode in opposing relation to the phosphor, separated by an evacuated space. In one embodiment, the cathode comprises a substrate; and an emitter disposed on the substrate and having a base and a tip; wherein said emitter comprises carbon in such an amount that a first carbon proportion at said base region is not higher than a second carbon proportion at said tip.

BRIEF DESCRIPTION OF THE DRAWINGS

The present invention will be better understood from reading the following description of nonlimitative embodiments with reference to the attached drawings, wherein.

DETAILED DESCRIPTION

According to one aspect of the invention, carbon is added to the emitter tips. According to one embodiment, the base material for a substrate on which the tips are formed is amorphous silicon, and the percentage of carbon versus silicon is generally greater at the top region of the emitter tip than at the base region.

In one embodiment of the present invention, there is almost no silicon at the top region so that a film of amorphous carbon covers the cathode structure resulting in a carbon tip. Actually, to obtain a very carbon-rich tip, a very high proportion of carbon is deposited and the silicon is etched away in a subsequent step. The result of this embodiment is a porous carbon tip.

According to another embodiment of the present invention there is a continuous gradient between the base region and the top region of the emitter tip. Typically, there is almost no carbon at the base and almost no silicon at the top. According to a further embodiment of the present invention, the grading of the carbon is modified such that a top region having a specified thickness consists of amorphous carbon, whereas the lower regions of the emitter tip down to the base region are graded. The lower portion consists of the alloy of amorphous silicon and amorphous carbon, the amount of silicon increasing towards the base.

Thus, a variety of embodiments of the present invention are produced, in which silicon carbide films are manufactured, depending on the desired mechanical and electrical properties of the emitter tip.

Figure 1:
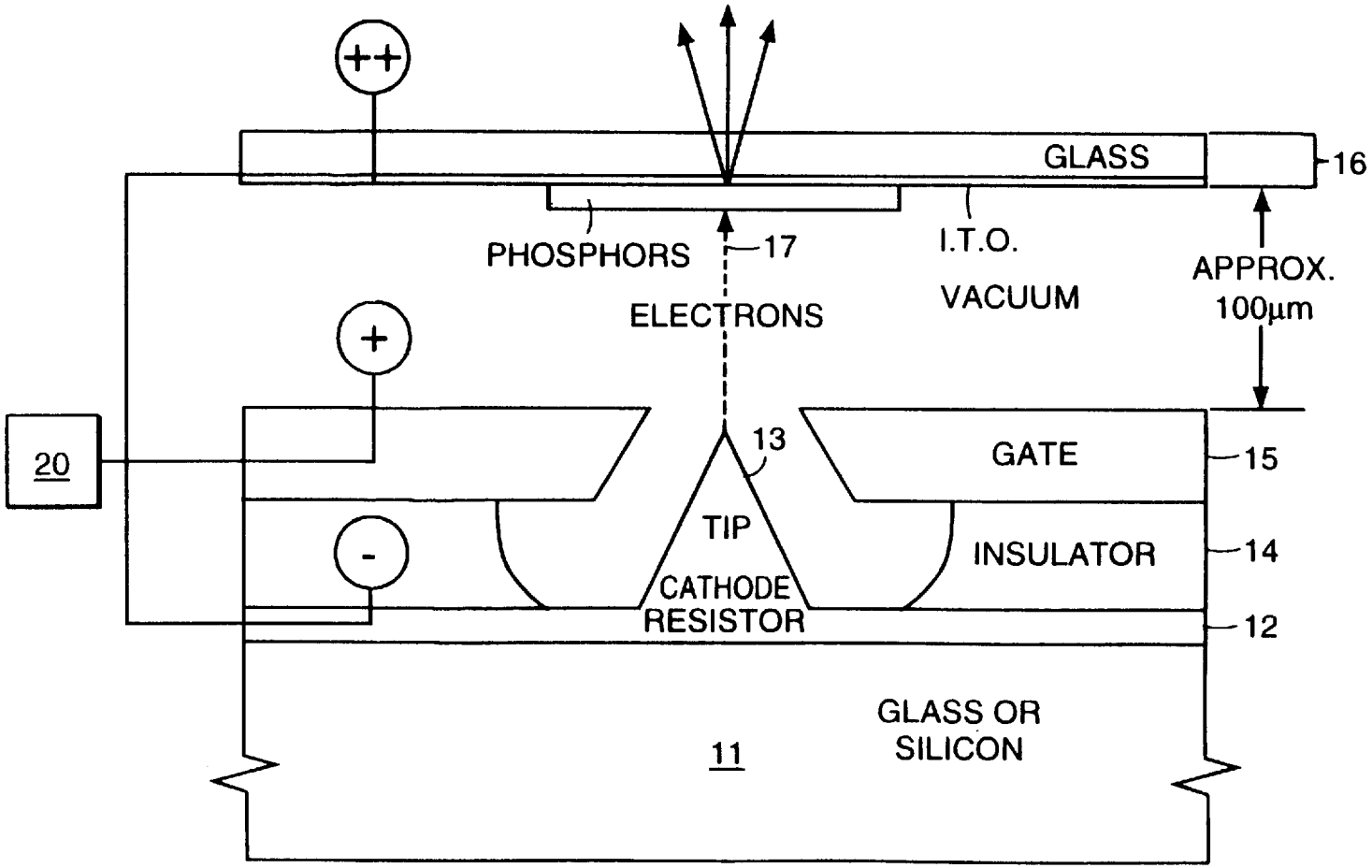
FIG. 1 is a cross-sectional view of a picture element and a cold cathode emission site of a field emission display.

Referring now to FIG. 1, an example embodiment of the present invention is shown having cathode structure comprising a substrate 11, a cathode resistor 12 and an emitter tip 13, used in a field emission display. Also shown are an insulator 14, a gate or extraction grid 15, a phosphor-coated glass anode 16, an electron beam 17 in the vacuum space between the cathode structure and the anode structure, and a voltage source 20.

Figure 2A:
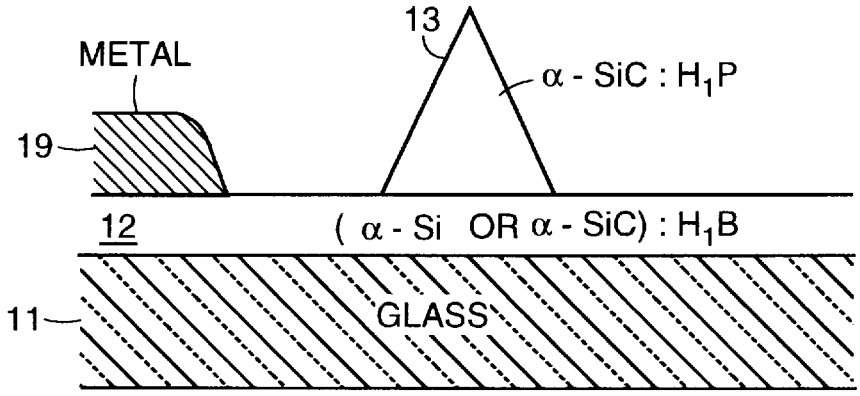
FIG. 2A is an elevational view of a cold cathode emission tip comprising amorphous carbon in accordance with the present invention.

Referring now to FIG. 2A, an embodiment of the present invention is shown using amorphous silicon emitter technology, although, according to alternative embodiments, crystalline and partially amorphous-partially crystalline graded films are used, as well. In this example, substrate 11, which supports the totality of the cathode structure, is made from glass. Single crystal silicon is used according to another embodiment, as are combinations of glass and silicon, according to even further embodiments. According to the FIG. 2A embodiment, thin film 12 of amorphous silicon or amorphous silicon carbide is deposited on the glass substrate 11. The amorphous silicon is lightly doped with boron, resulting in a p-type film 12. The film 12 is resistive, having a specific resistance in the order of $10^5$ Ohm-cm. Any other resistive material is applicable which provides for the resistor between an emitter tip 13 and a metal contact 19.

It is to be noted that a certain amount of carbon may be present already in the resistive film 12, as the fabrication of the film 12 and the layer (from which the emitter tips 13 are made) are closely related. As is apparent from FIG. 2B, an n-type layer 13 is used for emitter tip formation. The amorphous silicon of the layer 13 is typically doped with phosphorous. Layer 13 is more conductive than film 12, the specific resistance being in the order of $10^2$ Ohm-cm. The acceptor dopants, like boron, and the donor dopants, like phosphorous, are chosen to adjust the conductivity of the amorphous silicon carbide alloy.

Film 12 and layer 13 are placed on substrate 11 by plasma-enhanced chemical vapor deposition ("PECVD"), according to one acceptable deposition method. During this process, the carbon content of the film may be controlled as it is deposited by adjusting any one or combination of parameters. These parameters may be, for example, substrate temperature, gas mixture composition, RF power, total gas flowrate, chamber pressure, and sidewall temperature. Most notably, the carbon content may be tailored via the addition of carbon containing gas species such as the organosilicon TMSiH or methane CH4.

Alternatively, layers 12 or 13 from which the emitter tips are formed is deposited by a sputtering method. In this approach, the SiC may be the sputter target material and the Si C ratio being controllable by adjusting sputtering process parameters such as power, chamber pressure, substrate temperature, and substrate-to-target voltage. Further, a Si sputtering target may be used and a carbon-containing gas, alone or in addition to another gas such as argon, may be then introduced between the target and the substrate. In this manner, during the sputtering of the Si target, some fraction of carbon is incorporated in the film resulting in a deposited $Si_xC_{1-x}$ alloy. The fraction of carbon (or x, where x may vary between 0 and 1) can then be controlled by process parameters such as substrate temperature, chamber pressure, gas mixture, DC bias and power. The carbon-containing gas species in this case may be methane CH4 or some similar alkane gas. In addition, as a further embodiment, the Si—C alloy layers may be deposited by a vacuum arc method, either anodically or cathodically. The carbon content of the resultant layer may be adjusted via process parameters such as substrate temperature, pressure, power, or the addition of a carbon-containing gas, for example methane or a similar alkane gas. In this method, the anode or cathode may be made of Si or SiC and is consumed in the arc process and subsequently deposited on the adjacent substrate.

Standard deposition, photolithographic, and etching techniques are subsequently employed to generate a hard mask on the amorphous silicon carbide layer 13. As depicted in FIG. 2A, for example, PECVD oxide may be deposited as a thin layer and photolithographically patterned and subsequently etched providing a hardmask of dots. These dots are then used as an etch mask for etching the emitter tips. Thereafter, the masks remaining on top of the emitter tips 13 are removed by standard techniques.

Figure 2B:
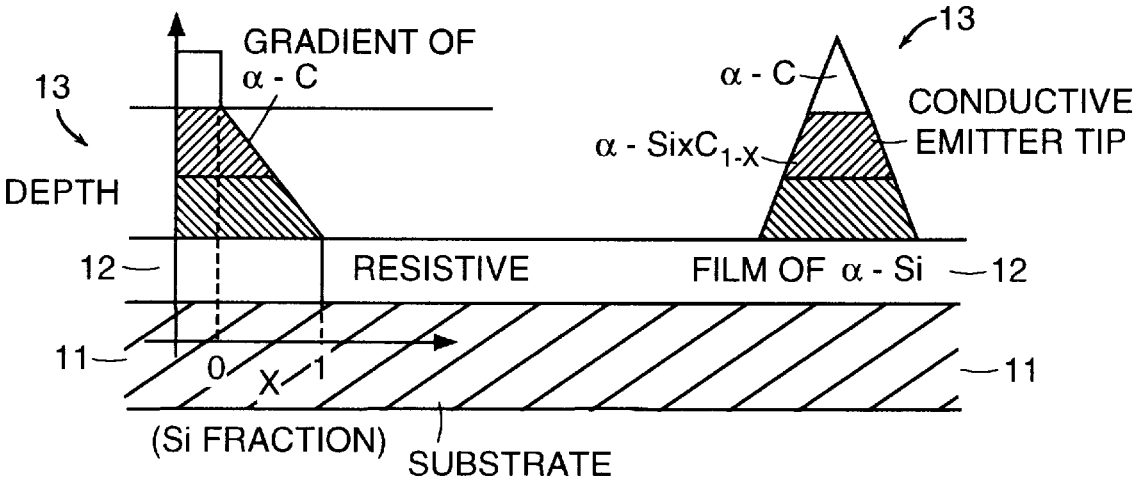
FIG. 2B is a schematic view of the layered structure of the cold cathode emission site according to the present invention, before and after forming the emission tip.

As discussed above, by adjusting various parameters during the deposition of the layer 13, and optionally also during the deposition of the film 12, the relative amount of carbon generally increases as the fabrication proceeds from the base of the emitter tip 15 to the top region thereof. FIG. 2B depicts one of the examples already mentioned. The top region consists almost 100% of amorphous carbon, followed by a gradual decline such that the proportion of silicon overrides in the base region of the emitter tip 13 adjacent to the resistive film 12. The present invention is, however, not limited to a continuous, or linear gradient as shown in FIG. 2B. Other levels of carbon proportion can be employed in the top region and in the base region and more abrupt changes of the carbon proportion may occur.

There are some major benefits and advantages in enriching the emitter tip 13 with amorphous carbon. The emitter tip 13 becomes harder, as compared to silicon as a basic material of the emitter tip. Because of the increased hardness, such an emitter might be referred to as "diamond"; however, this term is misleading with respect to the atomic structure and therefore avoided.

Furthermore, the stability of the emitter tip 13 is increased, because the carbon has more durability and is a better heat sink than silicon. Moreover, the work function for describing the resistance for the electrons to escape from the material into vacuum is lower.

The gradient in the relative amount of carbon leads to another very important benefit of the present invention. Additional process steps can be employed for differentially sharpening the emitter tip 13. For example, see U.S. Pat. No. 5,358,40, incorporated herein by reference. The basis for the differential sharpening is that the ability of the silicon carbide alloy to oxidize depends on the relative proportion of the carbon component. As the amorphous silicon carbide is oxidized to form a silicon oxycarbide, the oxidation is less for the carbon component than for the silicon component. Consequently, when an oxide layer is grown on the emitter tip 13, the oxidation growth is less in the top region and more in the base region.

Figure 3A:
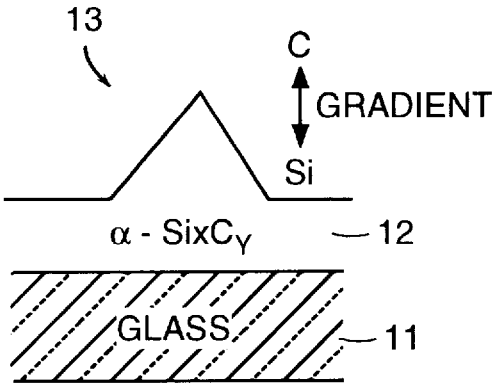
FIG. 3 is a schematic view of an self-limiting oxidation process for sharpening the emitter tip according to the present invention.
Figure 3B:
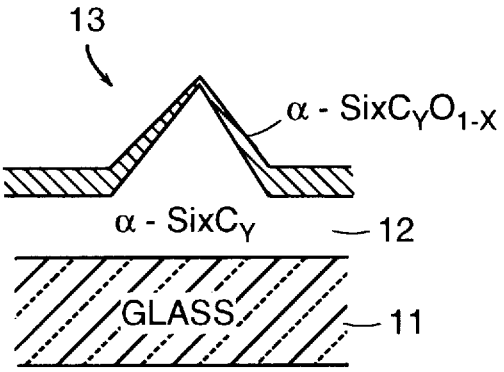
Figure 3C:
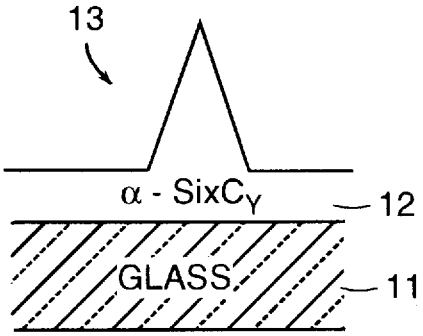

This effect lends to a self-limiting oxidation sharpening process. As shown in FIG. 3, step A, the sharpening process starts with a tip 13 as formed according to the preferred embodiment of FIG. 2B. Proceeding from step A to step B, a thin layer of silicon oxycarbide is grown on the tips 13.

Several alternative methods of oxidation are employed according to the present invention. For example, using anodic oxidation, the device is put in an electrolytic bath and a material charge transfer is applied between an anode and the device as a cathode. Using plasma oxidation, the effect of electron cyclotron resonance is employed to oxidize the surface of the emitter tip 13. Using thermal oxidation, the tip 13 is heated in an oxygen-rich environment to a temperature which is comparable to the deposition temperatures of the amorphous silicon carbide.

In any case, a thin, approximately 100 Å thick layer of silicon oxycarbide is grown on the surface of the emitter tip 13. The oxidation process is self-limiting in so far, as the growing oxide layer passivates and prevents further growth.

Referring to FIG. 3, and proceeding from step B to step C, the tips 13 are etched to remove the silicon oxycarbide. Wet-etching is an acceptable etch process. The resulting emitter tips 13 are sharpened with respect to the emitter tips of step A. The sharp amorphous silicon carbide tips are advantageously applied in field emission displays of the type shown in FIG. 1.

A plurality of further steps is necessary to obtain a high-resolution field emission display. Typically, the manufacturing process will proceed with the formation of a matrix of thin-film transistors in the resistive film 12. Such type of drive electronics is implementable not only in a silicon film, but also when the thin film 12 is composed of amorphous silicon carbide.

All of the U.S. patents cited herein are hereby incorporated by reference as set forth in their entirety.

While some particular processes as herein shown and disclosed in detail are fully capable of obtaining the objects and advantages herein before stated, it is to be understood that it is merely illustrative of the presently preferred embodiments of the invention and that no limitations are intended to the details of construction or design herein shown other than mentioned in the appended claims.

What is claimed:

1. A field emission device comprising:

an anode having phosphor deposited thereon;

a cathode in opposing relation to the phosphor, separated by an evacuated space, the cathode comprising:

a substrate;

a film disposed over the substrate; and an emitter disposed over the film and having a base and a top, the emitter including silicon and carbon, a distribution of carbon in the emitter being substantially uniform in a horizontal direction and substantially non-uniform in a vertical direction, a ratio of carbon to silicon in the emitter top being greater than a ratio of carbon to silicon in the emitter base.

2. A device as in claim 1, wherein said substrate comprises glass.

3. A device as in claim 1, wherein said film comprises a thin, resistive deposition of amorphous silicon having a resistivity higher than the emitter material.

4. A device as in claim 3, wherein said thin resistive film further comprises amorphous carbon and is doped with an acceptor material.

5. A device as in claim 4, wherein said acceptor material comprises boron.

6. A device as in claim 1, wherein said emitter comprises said carbon in amorphous form and is doped with a donor material.

7. A device as in claim 6, wherein said donor material comprises phosphorus.

8. A device as in claim 7, wherein substantially all regions of said emitter top consist of carbon.

9. A device as in claim 1, wherein said emitter base comprises substantially no carbon.

10. A device as in claim 1, wherein said emitter top comprises substantially no silicon.

11. A method for manufacturing an emitter, comprising:

forming a layer of resistive material;

forming a conductive layer over the layer of resistive material, the conductive layer including silicon and carbon, a distribution of carbon in the conductive layer being substantially uniform in a horizontal direction and substantially non-uniform in a vertical direction;

removing material from the conductive layer to define a conical emitter tip extending from a base region to a top region, a ratio of carbon to silicon in the top region being greater than a ratio of carbon to silicon in the base region.

12. A method as in claim 11, wherein said forming a layer of resistive material comprises chemical vapor deposition of p-type amorphous silicon.

13. A method as in claim 11, wherein said forming a conductive layer comprises plasma-enhanced chemical vapor deposition of n-type amorphous silicon carbide by adding a carbon containing gas.

14. A method as in claim 13 wherein the carbon containing gas comprises trimethylsilane.

15. A method as in claim 13 wherein the carbon containing gas comprises methane.

16. A method as in claim 11, further comprising the steps of:

growing a layer comprising an oxycarbide on said emitter tip, the oxycarbide layer being thicker at said base region than at said top region; and removing said oxycarbide layer.

17. A method as in claim 11, wherein said forming a conductive layer comprises sputtering of amorphous silicon and introducing a carbon-containing gas to produce an alloy of amorphous silicon and amorphous carbon.

18. A method as in claim 17, wherein the carbon-containing gas comprises methane.

19. A method as in claim 11, wherein the forming a conductive layer comprises cathodic arc deposition of a silicon cathode and introducing a carbon-containing gas.

20. A method as in claim 19, wherein the carbon-containing gas comprises methane.

21. A method as in claim 11, wherein the forming a conductive layer comprises anodic arc deposition of a silicon anode and introducing a carbon-containing gas.

22. A method as in claim 21, wherein the carbon-containing gas comprises methane.

23. A method as in claim 16, wherein said growing an oxycarbide layer comprises anodic oxidation.

24. A method as in claim 16, wherein said step of growing an oxycarbide layer comprises plasma oxidation.

25. The method according to claim 16, wherein said step of growing an oxycarbide layer comprises thermal oxidation in an oxygen-rich atmosphere.

26. The method according to claim 16, wherein the step of removing said oxycarbide layer comprises wet-etching.

27. An emitter tip for a field emission device, the emitter tip extending from a base region to a top region, the emitter tip including silicon and carbon, a distribution of carbon in the emitter tip being substantially uniform in a horizontal direction and substantially non-uniform in a vertical direction, a ratio of carbon to silicon in the top region being greater than a ratio of carbon to silicon in the base region.

28. An emitter tip according to claim 27, wherein relative amounts of silicon and carbon in the emitter tip are described by the formula $Si_xC_{1-x}$, the value of x being between zero and one and being larger at the base region than at the top region.

29. An emitter tip according to claim 28, wherein the value of x decreases monotonically from the base region to the top region.

30. An emitter tip according to claim 27, wherein said base region comprises amorphous silicon.

31. An emitter tip according to claim 27, wherein said base region comprises substantially no carbon.

32. An emitter tip according to claim 27, wherein said top region comprises amorphous carbon.

33. An emitter tip according to claim 27, wherein said top region comprises substantially no silicon.

34. An emitter tip according to claim 27, wherein the emitter tip is doped with phosphorous.

35. An emitter tip for a field emission device, the emitter tip extending from a base region to a top region, the emitter tip including silicon and carbon, a carbon-silicon mixture being disposed throughout a region of the emitter tip between the base and top regions, a ratio of carbon to silicon in the top region being greater than a ratio of carbon to silicon in the base region.

36. A method for manufacturing an emitter tip, comprising:

forming a conductive layer including silicon and carbon, a distribution of carbon in the conductive layer being substantially uniform in a horizontal direction and substantially non-uniform in a vertical direction;

removing material from the conductive layer to define a conical emitter tip extending from a base region to a top region, a ratio of carbon to silicon in the top region being greater than a ratio of carbon to silicon in the base region.

* * * * *